United States Patent [19]

Wolfe

[11] 4,254,383

[45] Mar. 3, 1981

[54] INVERTED MICROSTRIP PHASE SHIFTER

[75] Inventor: Allen R. Wolfe, Sauquoit, N.Y.

[73] Assignee: General Electric Company, Utica, N.Y.

[21] Appl. No.: 86,886

[22] Filed: Oct. 22, 1979

[51] Int. Cl.[3] ..... H01P 1/185; H01P 3/08; H01P 5/08

[52] U.S. Cl. ..... 333/161; 333/157; 333/164; 333/246; 333/248

[58] Field of Search ..... 333/156–157, 333/161, 164, 245–247, 204–205, 208–209, 248, 21 R, 24 R

[56] References Cited

U.S. PATENT DOCUMENTS

| | | | |
|---|---|---|---|
| 3,566,311 | 2/1971 | Buck | 333/161 |
| 3,790,908 | 2/1974 | Burns | 333/157 |
| 3,904,997 | 9/1977 | Stinehelfer, Sr. | 333/247 |
| 4,023,125 | 5/1977 | Wolfe | 333/262 X |
| 4,024,478 | 5/1977 | Wolfe | 333/1.1 |

OTHER PUBLICATIONS

Boyd–"A Dual-Mode Latching Reciprocal Ferrite Phase Shifter", IEEE Trans. on Microwave Theory and Techniques, vol. MTT-18, No. 12, Dec. 1970; pp. 1119–1124.

Davis–"Integrated Diode Phase-Shifter Element For an X-Band Phased Array Antenna", IEEE Trans. on Microwave Theory and Techniques, Dec. 1975; pp. 108–1084.

Terrio et al.–"A Low Cost P-I-N Diode Phase Shifter For Airborne Phased-Array Antennas", IEEE Trans. on Microwave Theory and Techniques, vol. MTT-22, No. 6, Jun. 1974; pp. 688–692.

*Primary Examiner*—Marvin L. Nussbaum

*Attorney, Agent, or Firm*—Ralph M. Savage

[57] ABSTRACT

The inverted microstrip phase shifter consists of a substrate having at least one diode and biasing circuitry connected to one side and at least one center conductor connected to its opposite side. The substrate side containing a center conductor is enclosed within a hollow case so as to form an rf transmission line. The parameters for the biasing circuitry are selected by performing a computer optimization of the chain matrix equivalent expression for the voltage transmission coefficient.

3 Claims, 7 Drawing Figures

INVERTED MICROSTRIP PHASE SHIFTER

BACKGROUND OF THE INVENTION

1. Field of the Invention

This invention relates generally to microwave systems, and more particularly to a loaded line inverted microstrip phase shifter.

2. Description of the Prior Art

There are basically three alternatives for realizing phase shifters for use in airborne phased array antenna applications. The first alternative is the conventional microstrip approach which has been described in many technical articles e.g., "Integrated Diode Phased-Shifter Elements For An X-Band Phased Array", Mark E. Davis, IEEE Transactions on Microwave Theory and Techniques, December, 1975, pp. 1080–1084. Compared to this approach, the instant invention has much higher power handling capabilities and lower insertion loss. Furthermore, the inverted microstrip phase shifter has the advantage of being easy to hermetically seal.

A second alternative is the strip line approach described by F. G. Terrio et al, in the article entitled "A Low Cost Pin Diode Phase Shifter For Airborne Phased Array Antennas", IEEE Transactions on Microwave Theory and Techniques, June 1974, pp. 688–692. A phase shifter designed according to this approach would also have higher losses and lower power handling capability than one designed according to the instant invention.

The third alternative is a reciprocal ferrite phase shifter which has been described by C. R. Boyd, Jr. in his technical article entitled "A Dual-Mode, Latching Reciprocal Ferrite Phase Shifter", IEEE Transactions on Microwave Theory and Techniques, December, 1970, pp. 1119–1124. The advantages of the instant invention over ferrite phase shifters is its phase stability over a broad temperature range, and the fact that the required drivers and switching circuitry are much less complex for the instant invention. The two most important characteristics of microwave phase shifters in an avionic system are a high power handling capability and a low insertion loss. Total line losses in a microwave transmission line include dielectric losses and conduction losses for materials used in diode phase shifters. For this reason, the instant invention was conceived in order to reduce such conduction losses.

Accordingly, it is an object of the present invention to provide a microwave phase shifter that has a combination of characteristics which will enable it to overcome the aforementioned disadvantages of the prior art devices and which make it particularly well suited to the requirements of avionic equipment. In particular, the desired characteristics include a low insertion loss, a higher power handling capability, hermetic sealability, and small size.

SUMMARY OF THE INVENTION

The inverted microstrip phase shifter is characterized by the fact that one side of a dielectric substrate contains biasing circuitry capacitively coupled to the conducting line on the opposite side of the substrate. Such a design has enabled the first objective of the invention to become satisfied, that is a phase shifter that possesses a low insertion loss.

The second objective is to attain a higher power handling capability with the inverted microstrip phase shifter. This has been achieved with the configuration of the instant invention.

BRIEF DESCRIPTION OF THE DRAWINGS

Various other objects, features and attendant advantages of the present invention will be more fully appreciated from the following detailed description in connection with the accompanied drawings.

DESCRIPTION OF THE PREFERRED EMBODIMENT

Figure 1:
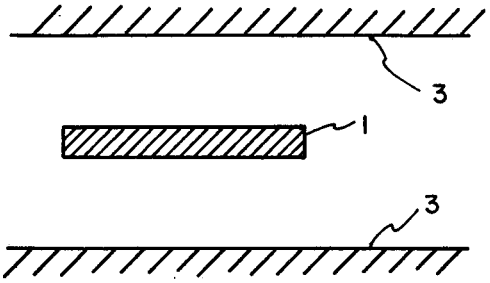
FIG. 1 is a cross sectional view of a prior art rf transmission line.

FIG. 1 represents a cross sectional view of a microwave transmission line with thin rectangular center conductor 1. Center conductor 1 will be the major source of the conduction loss because ground plane 3 will have a much larger conduction cross section than center conductor 1.

The conductor is assumed to have a resistance (r) per unit length given by $$r=p/(2\delta W) \tag{1}$$

where p is the conductor resistivity, $\delta$ is the skin depth, and W is the conductor width. The conductor thickness is neglected in this treatment. The center conductor transmission line loss per length $\Delta x$ is given by $$-i^2 r\,\Delta x=(dP/dx)\,\Delta x \tag{2}$$

The power decrement along the line is given by $$P=(i^2 z_o)e^{-\alpha x} \tag{3}$$

Applying equations (2) and (3) and taking only first-order terms results in $$\alpha=r/z_o \tag{4}$$

Neglecting fringing capacitance for a stripline configuration, $$z_o=94.25\ b/\sqrt{E_r W} \tag{5}$$

where b is the ground plane spacing. The skin depth $\delta$ is given by $\delta=\sqrt{2p/W}$ so that from equation (1), $$r=\sqrt{p}/\sqrt{8W} \tag{6}$$

Substituting in equation (4) for r and $z_o$ from equations (5) and (6) respectively yields the loss factor:

$$\alpha=\sqrt{pEr}/(94.25\ b\sqrt{8}) \tag{7}$$

Equation (7) provides a useful guideline for reducing line loss in a transmission line with stripline type cross section. Two parameters in equation (7) which the microwave designer has under his control are the ground plane spacing b and the relative dielectric constant Er.

Figure 2:
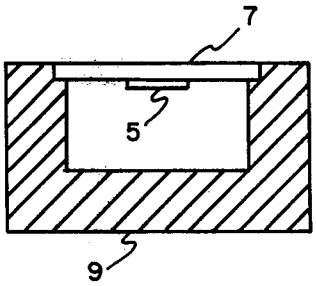
FIG. 2 is a cross sectional view of the inserted microstrip transmission line.

By the use of a material having a low dielectric constant e.g., air, and a large ground plane spacing, the loss factor represented by equation 7 can be minimized. FIG. 2 represents the cross section of a microwave transmission line which will hereafter be referred to as an "inverted microstrip". Conductor element 5 is affixed to one side of substrate 7 which is attached to housing 9.

Figure 3:
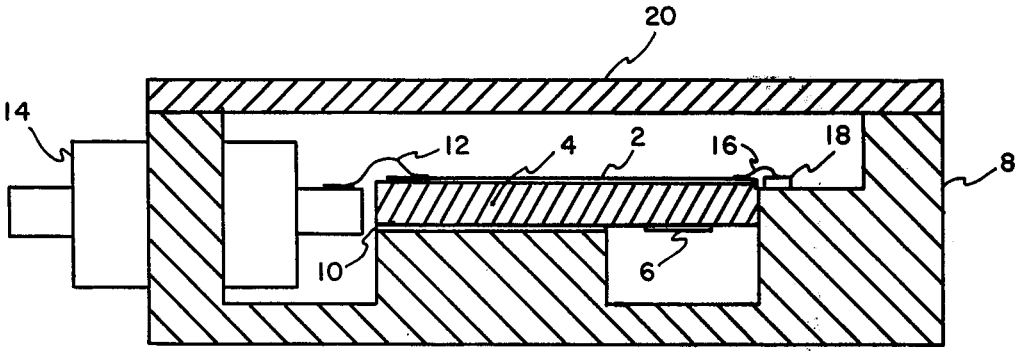
FIG. 3 is a cross sectional view of the inverted microstrip phase shifter.

FIG. 3 represents a loaded line phase shifter cross section which affords the unique opportunity of taking advantage of the low loss in an inverted microstrip configuration. The line loading elements comprise the bias circuitry 2 located on the first side of substrate 4. Substrate 4 functions as the supporting dielectric and also includes a conducting line 6 on its second surface which in FIG. 3 is opposite to said first surface. Substrate 4 is connected to metallic case 8 by means of an adhesion layer 10 which could be a material such as teflon (FEP). The bias voltage is applied to bias circuitry 2 via a first lead 12 which is connected to DC connector 14, which in turn is connected to the external circuitry. A second lead 16 connects bias circuitry 2 to diode 18 which is mounted in the metal housing of case 8.

Figure 4:
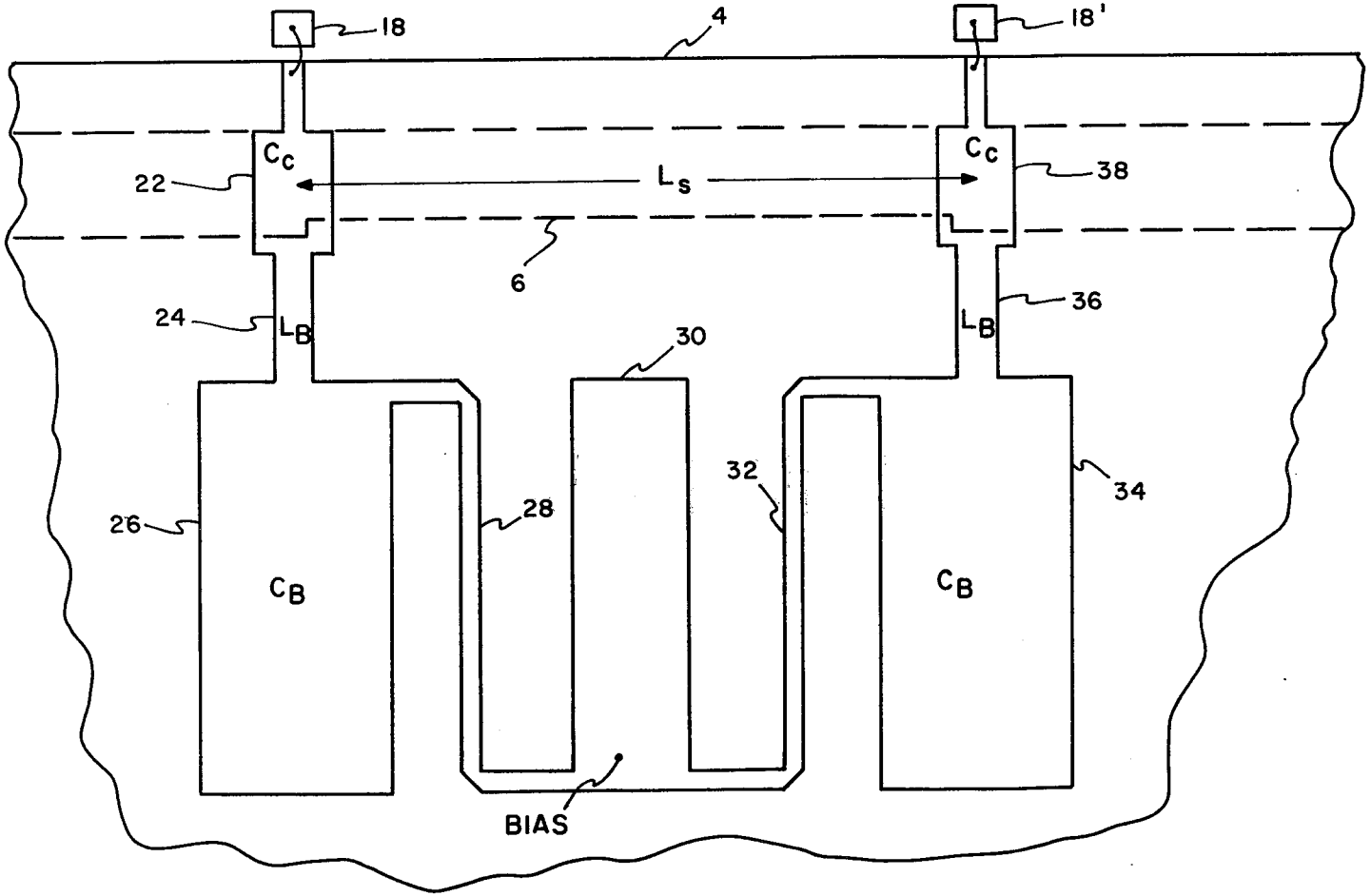
FIG. 4 is a top view of the substrate for the inverted microstrip phase shifter.
Figure 5:
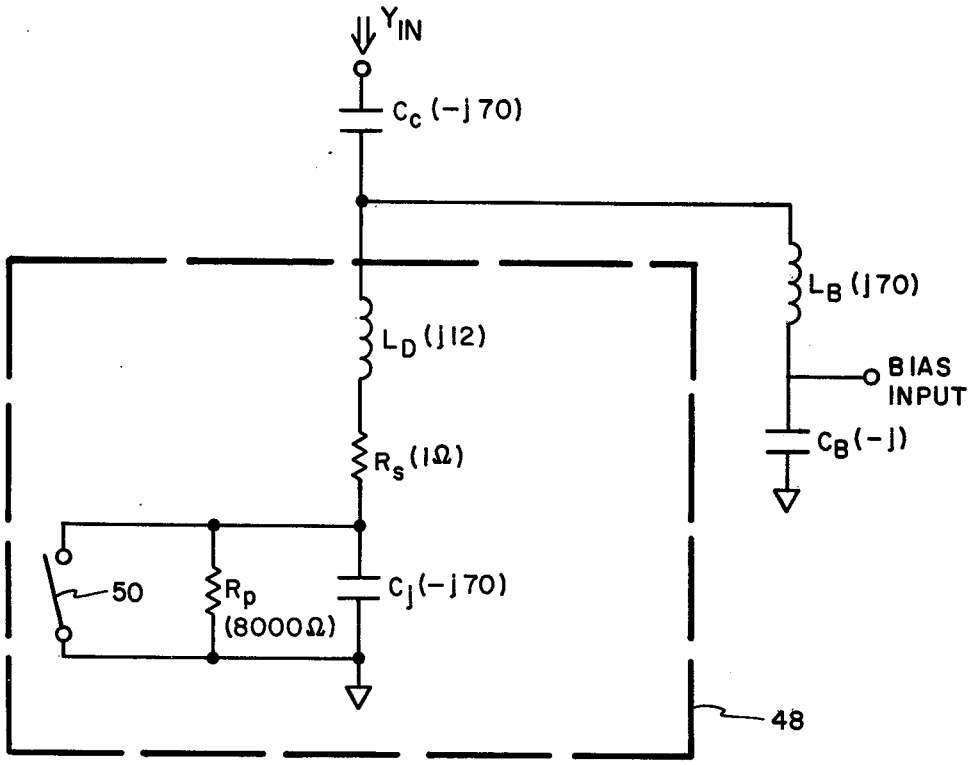
FIG. 5 is the equivalent circuit representation for the inverted microstrip phase shifter.

FIG. 4 represents the top view of the first surface of substrate 4, which shows 2 two state admittances. The loaded line elements 22, 24, 26, 28, 30, 32, 34, 36 and 38 are shown as right angle conductive stubs on top of the supporting dielectric. The active PIN diode chips 18 and 18' are mounted on case 8, resulting in the efficient heat sinking of the diodes. Because of this effective heat sinking and the high impedance levels available with the inverted microstrip, the inverted microstrip loaded line phase shifter average power handling capability has been conservatively calculated to be 25 watts using a diode with a capacitance of 0.1 pf, a forward resistance of 1 ohm, a reverse resistance of 3 ohms, and a quality factor of 50. The equivalent circuit of one of the switch line-loading elements is represented in FIG. 5. $L_D$ is the diode bonding wire conductance. Reactance values are illustrated in FIG. 5 for a 9.25 GHz center frequency. The substrate coupling capacitance is represented by $C_c$. $L_B$ represents the inductive reactance of the short stub connecting the line coupling capacitor to the quarter wavelength RF bypass. Phase shift bit size is determined by the size of the coupling capacitor and the length and width of the connecting stub. A computer aided design technique is used to optimize the bit performance by varying the size of the coupling capacitance $C_c$, and the length and width of $L_B$ and $L_S$, where $L_S$ is the conductance of the series segment of the transmission line which connects two adjacent substrate capacitance $C_c$. The value of $L_S$ has the effect of impedance matching the input impedance $Y_{IN}$, at each substrate capacitance $C_c$. The circuit is therefore optimized for insertion loss and return loss over the desired frequency range. The portion of FIG. 5 which is the equivalent circuit for diode 18 is represented by element number 48. One of the features which makes diode biasing easy in this configuration is the capacitive coupling of the admittance to the main line via capacitor $C_c$. When the diode is reverse biased, that is when switch number 50 is open, the main contributors to the input admittance are $C_c$ in series with $C_j$. This yields a relatively small amount of capacitive admittance which can be represented by the following equation:

$$Y_R \simeq \frac{j\omega^2 C_C C_j}{\omega C_C + \omega C_j} \tag{8}$$

When diode 18 is forward biased, that is when switch 50 is closed, the main contributor to the input admittance is simply $C_c$, which yields a relatively high capacitive admittance i.e., $Y_F = j\omega C_c$. The expressions for $Y_R$ and $Y_F$ have been presented only as an intuitive explanation of how the circuit works. In realty, the design is accomplished through the use of computer simulations and optimization techniques. In these simulations, $L_B$ and $C_c$ are better represented at RF frequencies as lengths of transmission line. The parameters which can be optimized for best insertion loss and proper phase shift over the frequency range of interest are $C_c$, $C_j$ and $L_B$. Also optimized are the length and impedance line segments used to connect two or more two-state admittances. A typical layout for a phase shifter bit involving two 2-state admittances is illustrated in FIG. 4. Most of the circuitry is printed on the top side of a dielectric substrate 4 (such as alumina) except for the main conductor line 6 which is printed on the bottom side. The diodes are attached directly to the metal case 8 along the edge of substrate 4. Typical substrate dimensions are 0.2552"×0.025"×2". The substrate can be teflon-attached to the raised center area of the sealed metal case in such a way as to leave the main conductor suspended primarily in air. One or more DC connectors can be hermetically sealed in the side wall of case 8 as shown in the drawings. Cover 20 can be welded in place to form hermetic seal on the top side of case 8.

Figure 6:
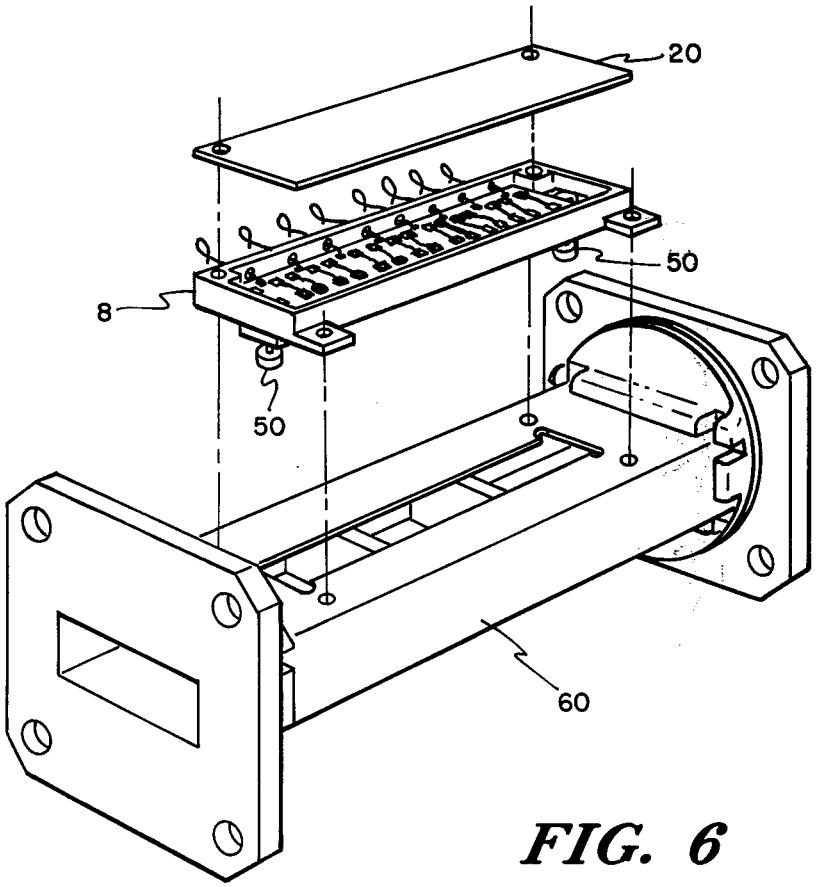
FIG. 6 is a isometric representation of the inverted strip phase shifter and a transmission line.

The RF transitions in and out of case 8 can be made by the use of sealed right angle probes 50 placed at the ends of case 8 as illustrated in FIG. 6. Further illustrated in the three dimensional sketch of FIG. 6 is the manner in which an individual n-bit phase shifter is mounted to waveguide feed structure 60.

The line length and impedance values for the transmission line segments $L_S$ and the line length of $L_B$ as well as the capacitance values for $C_c$ and $C_j$ are selected to give a maximum voltage transmission coefficient over the frequency band of interest.

The specific circuit parameters are calculated using an "exhaustive search" procedure based on computing voltage transmission coefficient values as a function of frequency for various assumed line length and impedance parameters and comparing the results until an optimum set of parameters is determined.

The equation for the voltage transmission coefficient is:

$$|T| = \frac{2}{A_E + B_E + C_E + D_E} \tag{9}$$

where $A_E$, $B_E$, $C_E$ and $D_E$ are elements of the equivalent matrix for the entire circuit illustrated in FIG. 4. Specifically the equivalent matrix for the FIG. 4 circuit is:

$$\begin{vmatrix} A_E B_E \\ C_E D_E \end{vmatrix} = \begin{vmatrix} 1 & 0 \\ Y_{IN} & 1 \end{vmatrix} \times \begin{vmatrix} A_{LS} B_{LS} \\ C_{LS} D_{LS} \end{vmatrix} \times \begin{vmatrix} 1 & 0 \\ Y_{IN} & 1 \end{vmatrix} \quad (10)$$

where:

$Y_{IN}$ is the net admittance loading the transmission line $A_{LS}$, $B_{LS}$, $C_{LS}$, $D_{LS}$ are the ABCD matrix elements for the $L_S$ transmission line segment.

More specifically, the values for $A_{LS}$, $B_{LS}$, $C_{LS}$ and $D_{LS}$ are as follows:

$$A_{LS} = \cosh \gamma L \qquad C_{LS} = \frac{1}{Z_o} \sinh \gamma L \quad (11)$$

$$B_{LS} = Z_o \sinh \gamma L \qquad D_{LS} = \cosh \gamma L \quad (12)$$

where $\gamma$=propogation constant $\alpha + j\beta$ per unit length of the segment L=segment length in mils $Z_o$=characteristic impedance of the segment The above method of determining T is known as the "chain matrix" analysis technique and is described in the literature. For example, see the text Microwave Filters, Impedance Matching Networks And Coupling Structures by G. Mathaei, L. Young and E. M. T. Jones, McGraw-Hill, 1964, pages 26–28.

Using equation (9) a first frequency response curve for the network is calculated by plugging in an initial set of assumed parameters and calculating T for each of a number of frequency points spread across the band of interest. The number of frequency points selected depends upon the number of peaks and valleys expected to exist in the response curve for the particular frequency band. For example, five equally spaced sampling points have been found to be adequate for the band from 9.0–9.5 GHz.

After a frequency response has been calculated with the initial set of assumed parameters, the parameters are thereafter varied in a systematic fashion, described below, and the results compared. After an optimum set of parameters has been ascertained using the first set of assumed input parameter values, a second set of assumed parameters is selected based on the results of the first calculations and the process is repeated. After completion of several iterations of the above computation, comparison and selection steps, the final calculated parameters are known to represent essentially the optimum parameters for the frequency band of interest.

Since the circuit shown in FIG. 5 can be forward and reverse biased, the important performance characteristics are the forward bias complex transmission coefficient, TF, the reverse bias complex transmission coefficient, TR, and the phase shift error, $E\phi$, defined as follows:

$$TF = \frac{2}{A_F + B_F + C_F + D_F} = |TF| \measuredangle \phi_F \quad (13)$$

$$TR = \frac{2}{A_R + B_R + C_R + D_R} = |TR| \measuredangle \phi_R \quad (14)$$

$$E\phi = |\Delta\phi - |\phi_F - \phi_R|| \quad (15)$$

where $\Delta\phi$ is the desired phase shift.

Figure 7:
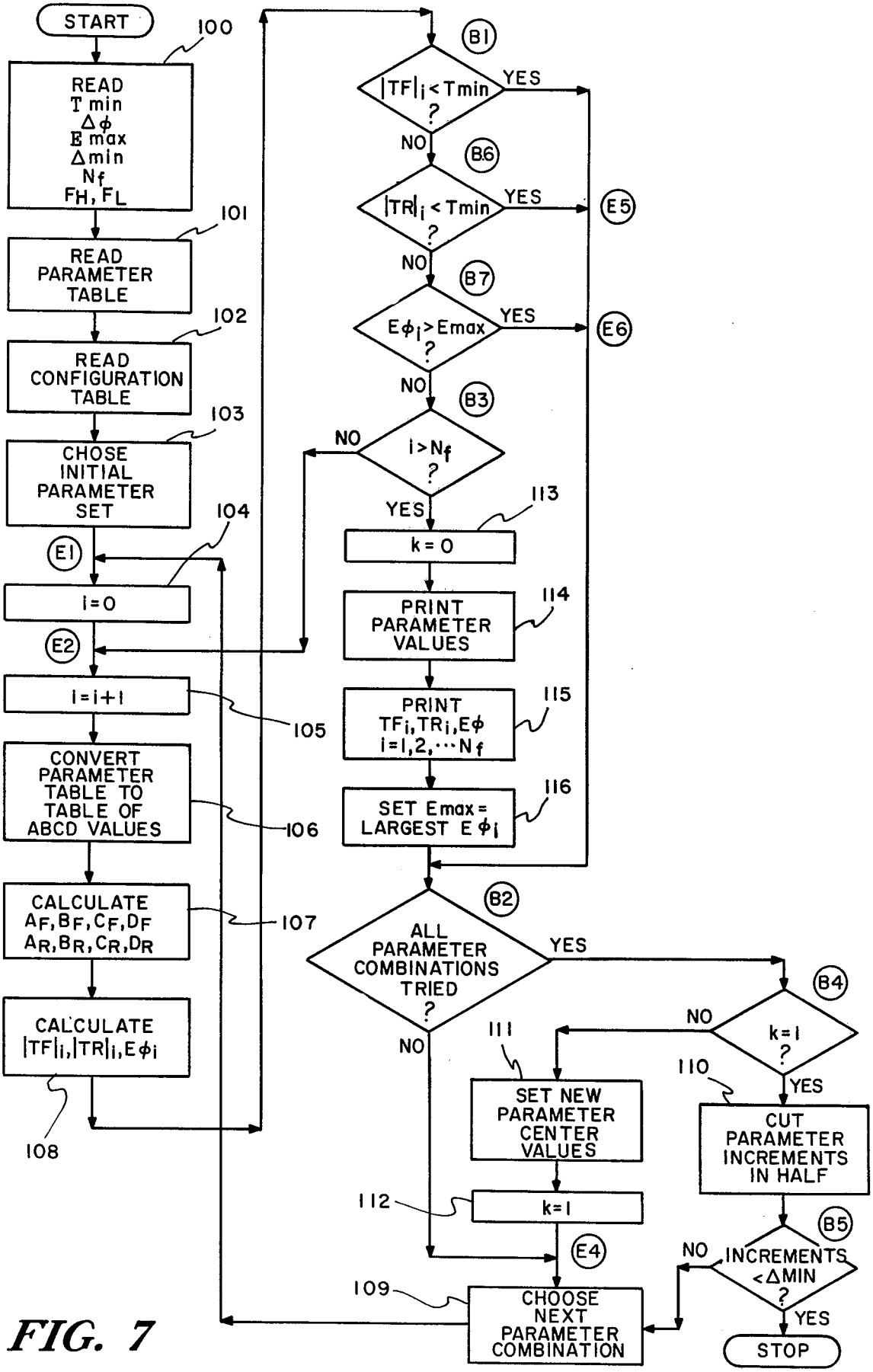
FIG. 7 is a flow diagram illustrating one form of a computer program that may be used for controlling the selection of optimum conductor line length and impedance parameters which will maximize the voltage transmission coefficient.

FIG. 7 represents a flow chart of the computer simulation used to perform the optimization calculations.

The first series of operations 100, 101 and 102 consists of reading the required initial data into the computer. $T_{MIN}$ is the minimum acceptable value for |TF| or |TR|. $N_F$ is the number of frequency sample points in the frequency band of interest for which values of |TF|, |TR| and $E\phi$ will be calculated. $\Delta\phi$ is the desired value of the phase shift for which the circuit is being optimized to achieve. $E_{MAX}$ is some value of $E\phi$ set high enough to ensure that all calculated $E\phi$ values for the initial set of chosen parameters will not exceed it.

$\Delta$ min is the smallest parameter value increment of interest for each parameter to be optimized (i.e. $L_S$, $L_B$ and $C_c$ and $C_j$. $F_H$ and $F_L$ are, respectively, the high and low frequencies in the frequency band of interest.

The "parameter table" is a collection of input data setting forth the initial conductor center parameters and the initial $\propto$ increments to be used to derive the associated upper and lower parameter values. The parameter table further includes data to identify the type of circuit elements in the network and a code designation for each parameter indicating whether or not the parameter is to be varied or held constant during the optimization process. The "configuration table" (operation 102) is a data sequence indicating the order in which the circuit elements are to be considered in the matrix multiplication computation (operation 107 used for determination of $A_F$, $B_F$, $C_F$, $D_F$, $A_R$, $B_R$, $C_R$, and $D_R$.

It is to be understood that the computer already has in storage the necessary subroutines for computing the ABCD matrix products for the different circuit elements and for computing |TF|, |TR| and $E\phi$.

After the read-in operations are completed, the computer selects an initial set of parameters for all the 50 circuit elements (FIG. 7, operation 103). While no particular set of initial parameters is required, one convenient set consists of the center values specified in the parameter table. The program then proceeds through entry point E1 to operation 104 where the control variable i is set to zero. Control variable i is used to provide a specific value of $\lambda$ (wavelength). In operation 105 i is incremented to 1, which indicates the first frequency sample point in the frequency band. Thereafter, the program calls out the appropriate subroutines for calculation of the ABCD matrix values for each circuit element (operation 106). Next, in operation 107, the matrix multiplication subroutine is exercised, resulting in calculation of the values for $A_F$, $B_F$, $C_F$, $D_F$, $A_R$, $B_R$, $C_R$ and $D_R$.

Operation 108 is then performed whereupon values for $|TF|_i$, $|TR|_i$, and $E\phi_i$ are computed using equation (2). Since the control variable $i$ is set at 1 the calculated values will be for the first frequency sample point in the frequency band. Next at branch point B1, $|TF|_i$ is compared with $T_{MIN}$ and if $|TF|_i$ is larger (which it must be for the first program cycle) branch point B6 is encountered. Here $|TR|_i$ is also compared with $T_{MIN}$ and if it also is larger, branch point B7 is encountered. Here $E\phi_i$ is compared to $E_{MAX}$ and if it is less than $E_{MAX}$, branch point B3 is encountered. If i does not exceed $N_F$ the program goes back to entry point EZ where operations 105, 106, 107 and 108 are again performed, resulting in computation of $|TF|_i$, $|TR|_i$ and $E\phi_i$ for the next frequency sample point in the band. Again branch points B1, B6, B7 and B3 are traversed in the "No" direction and the loop calculations for $|TF|_i$, $|TR|_i$, and $E\phi_i$ will again repeat. This continues until all values of $|TF|_i$, $|TR|_i$ and $E\phi_i$ are computed for $i=1$ through $i=N_f$.

After this, branch point B3 is traversed in the "YES" direction and operations 113, 114, 115 and 116 are performed. This results in the setting of the control flag bit K to zero (operation 113) and the printing out of the present $\phi$ and Z parameters and all the computed values for $|TF|_i$, $|TR|_i$ and $E\phi_i$. After that, $E_{MAX}$ is reset to be equal to the largest value of $E\phi_i$ just calculated (operation 116). The program then proceeds through branch point B2 in the N0 direction and performs operation 109 whereupon one of the parameter values for one of the circuit elements is changed to set up a new combination of parameters. The program then moves to entry point E1 whereupon a new computation cycle is begun for $|TF|_i$, $|TR|_i$ and $E\phi_i$. The process of setting up new parameter combinations in operation 109 may be controlled, for example, through use of a "nested D0 loop" routine which sequentially runs through the 37 different parameter combinations for each parameter set.

During the next computation cycle, as well as in all succeeding computation cycles for $|TR|_i$, $|TF|_i$ and $E\phi_i$, branch points B1, B6 and B7 act to automatically "throw out" any parameter combination which yields a $E\phi_i$ value greater than $E_{MAX}$ or a value for $|TF|_i$ or $|TR|_i$ which is less than $T_{MIN}$. That is, B1 is traversed in the YES direction if $|TF|_i$ is less than $T_{MIN}$ whereupon the program proceeds directly to branch point B2 and thence to operation 109 where a new parameter combination is chosen and a new cycle for the computation of $|TF|_i$, $|TR|_i$, and $E\phi_i$ is begun. Likewise the program will be diverted to branch point B2 if either $|TR|_i$ is less than $T_{MIN}$ or $E\phi_i$ is greater than $E_{MAX}$. However, for any parameter combination which simultaneously produces $|TR|_i$ values all greater than $T_{MIN}$, $|TF|_i$ values all greater than $T_{MIN}$ and $E\phi_i$ values all less than $E_{MAX}$, the computation cycle will be completed through $N_F$ and thereafter the program will proceed through branch point B3 to operations 113, 114, 115 and 116. The result is that the last parameter combination to be printed out is always the best parameter combination encountered up to that point.

When all combinations of a given set of parameters have been tried, branch point B2 is traversed in the YES direction and the program will either set up a new set of parameter center values (operation 111) or set up a narrower set of upper and lower parameter selection increments (operation 110), depending on the value of flag bit K. K is initially set at 0 in operation 113. After the initial set of parameters is exhausted, branch point B4 is traversed in the NO direction so that operation 111 is selected. This sets up a new set of parameter center values equal to those values stored in the print readout registers (re operation 114). As previously mentioned those stored parameter values, being the last ones printed out during the preceding computation cycle for $|TF|_i$, $|TR|_i$ and $E\phi_i$, are the best parameter values discovered to that point.

Thus, the next series of computation cycles will be carried out using the best previously discovered set of parameters as the new center values and using the same upper and lower parameter selection increments as before (i.e., $\pm 32°$ for $\phi$ and $\pm 0.4$ for Z).

Flag bit K is set to 1 in operation 112 following selection of the new parameter values.

However, if the program runs through an entire parameter set ($3^7$ computation cycles) without ever traversing branch point B1 in the NO direction, branch point B4 will be traversed in the YES direction. This selects operation 110 such that the previous parameter center values are retained but the parameter increments are cut in half so that the upper and lower parameter values are drawn in closer to their associated center values.

After that branch point B5 is traversed in the "NO" direction and the ensuing computation cycles will result in a finer resolution of the parameter selection process due to the use of the narrower parameter upper and lower selection increments. After the program has run through operation 110 several times, the parameter values will have been "honed" to the point where an additional halving of the upper and lower selection increments will result in parameter values which cannot be achieved in the manufacturing process used for plating the conductor segments. When this occurs the $\Delta$min limit is exceeded and branch point B5 will be traversed in the YES direction. This terminates the program.

The parameter values last printed out in operation 114 are the optimum parameters for the frequency band specified.

In the above program, a substantial computer time savings can be realized if the computation cycles are processed by running through the most "suspect" frequency sample points first. That is, the circuit designer should be able to predict which frequency points are likely to exhibit degraded performance. This most often is true of frequency points near the band edges. If these points are calculated at the beginning the computation cycle for each parameter combination, rejection of unsatisfactory parameter combinations at branch point B1 will take place sooner so that aggregage computer time is reduced.

The above description of the computation procedures and computer program steps required for obtaining an optimum set of circuit parameters is not necessarily the only computation method or program that can be used. It is, however, considered by the inventor as the preferred procedure as of the time of filing the present application.

What is claimed as new and desired to be secured by Letters Patent of the United States is:

1. An inverted micro-strip phase shifter on an RF transmission line with minimum attenuation of a broadband RF signal on said line, comprising in combination:

a hollow metallic case having at least one open side;

a D.C. connector located through an opening in said metallic case so that at least one D.C. voltage can be applied within a hollow area of said metallic case;

a substrate positioned within said metallic case having a first surface and a second surface, said first surface being exposed to a first hollow area within said metallic case and said second surface being exposed to a second hollow area within said metallic case;

bias circuitry located on said first surface of said substrate;

at least one center conductor located on said second surface of said substrate;

an adhesion layer for permanently mounting said substrate upon a portion of said metallic case;

a first lead connecting said D.C. connector to said bias circuitry;

a diode having a first and a second end, said first end being connected to said metallic case;

a second lead connecting said second end of said diode to said bias circuitry; and at least one cover for enclosing any open sides of said metallic case.

2. The inverted micro-strip phase shifter set forth in claim 1 wherein said bias circuitry further comprises printed signal conductors having different line length values, said line length values being selected to provide substantially the maximum voltage transmission coefficient across said signal conductors over the frequency range of said broadband signal.

3. The inverted micro-strip phase shifter set forth in claim 1 wherein said bias circuitry further comprises printed signal conductors having different line length and impedance values, said line length and impedance values being selected to provide substantially the maximum voltage transmission coefficient across said signal conductors over the frequency range of said broadband signal.

* * * * *